United States Patent [19]

Randolph, Sr.

[11] 3,983,739

[45] Oct. 5, 1976

[54] WORK PERFORMING MEMBER WITH REMOVABLE HEAD

[75] Inventor: Allan E. Randolph, Sr., Dayton, Ohio

[73] Assignee: Dayton Progress Corporation, Dayton, Ohio

[22] Filed: June 9, 1975

[21] Appl. No.: 585,077

[52] U.S. Cl. ..... 72/478; 72/479; 72/DIG. 15; 83/698; 83/700

[51] Int. Cl.[2] ..... B21D 37/04

[58] Field of Search ..... 72/478, 479, 480, 481, 72/482, DIG. 15; 83/698, 699, 700; 279/89, 90, 91, 93; 403/263

[56] References Cited

UNITED STATES PATENTS

| | | | |
|---|---|---|---|
| 2,616,712 | 11/1952 | Mueller | 279/91 |
| 2,767,990 | 10/1956 | Jewell | 83/698 |
| 2,920,913 | 1/1960 | Antila | 83/698 |
| 3,429,212 | 2/1969 | Weisbeck | 83/698 |
| 3,719,117 | 3/1973 | Mauk et al. | 83/698 |
| 3,797,352 | 3/1974 | Smith | 83/699 |
| 3,848,452 | 11/1974 | Gargrave | 83/700 |

*Primary Examiner*—Lowell A. Larson

*Attorney, Agent, or Firm*—Jerome P. Bloom

[57] ABSTRACT

A work performing member in the nature of a tool or die component comprised of multiple axially related parts including one element which has a work performing end and a shank end and a second element capping the shank end and forming an extension thereof as well as forming thereon a head. The shank end of the one element and the head provided by the other are so formed to effectively and simply key together in an unmistakable fashion whereby to prevent rotation of one relative the other and means are provided for interconnection of the head element to the shank end of the other element in a manner to achieve a pressured connection thereof. Said head element, in a preferred embodiment is further characterized by a form emphasizing the pressured and precisely related disposition of the elements in the connection thereof by the positioning thereof through the medium of alignment pins utilizing means and methods such as described in the U.S. Letters Pat. No. 3,797,352.

The work performing member of the invention is characterized by a facility of being able to be readily reduced as to its length at an intermediate station thereof on a simple and temporary removal of its head element.

10 Claims, 4 Drawing Figures

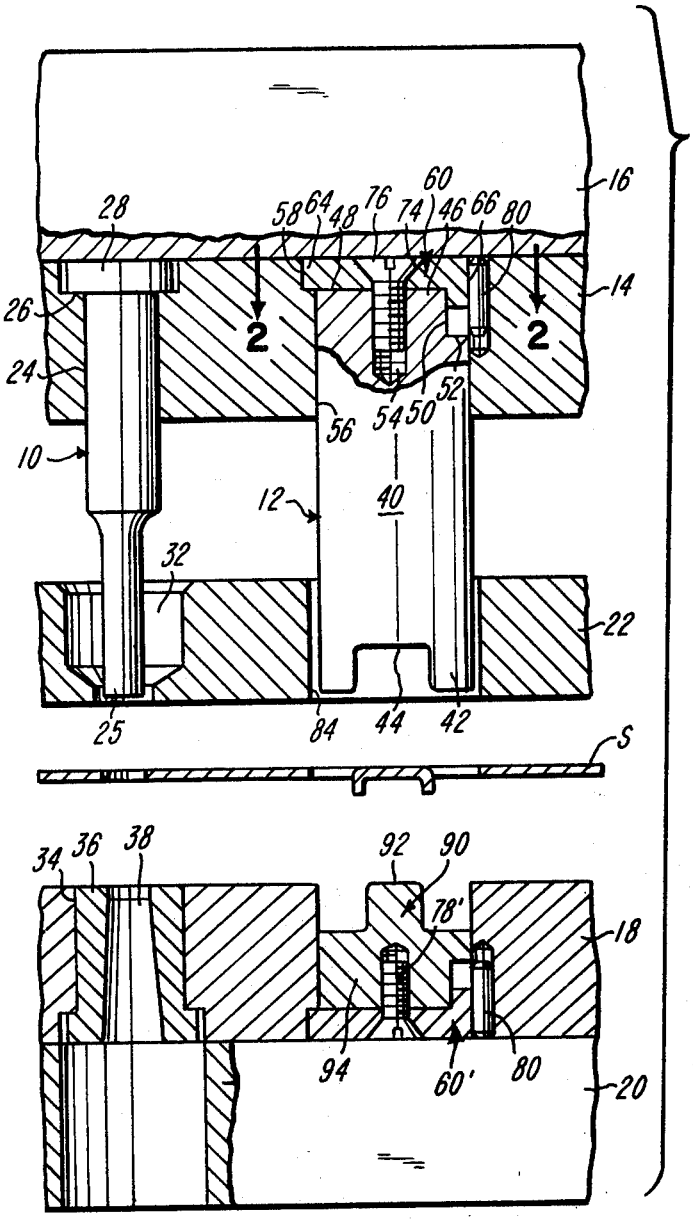
FIG-1
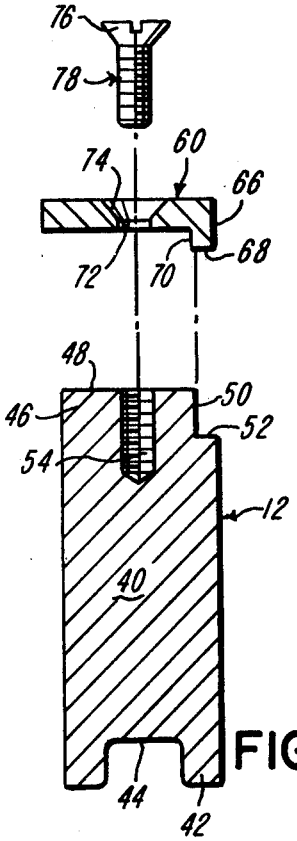
FIG-3
FIG-2
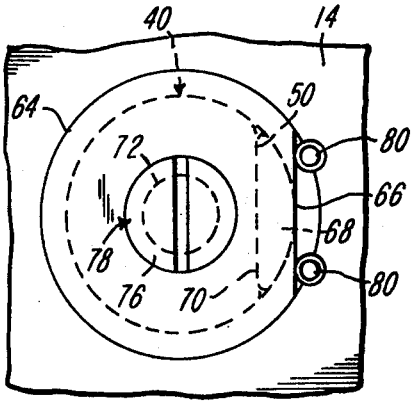
FIG-4
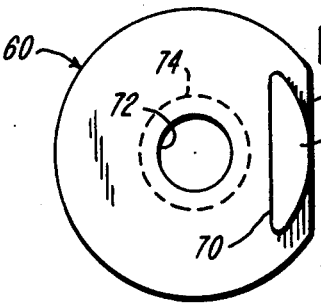

WORK PERFORMING MEMBER WITH REMOVABLE HEAD

BACKGROUND OF THE INVENTION

The tool and die industry has been constantly plagued by the cost, difficulty and down time occasioned in servicing die assemblies due to the frequent need for sharpening worn or damaged die tools. Each time one tool of an assembly must be sharpened there is a consequent reduction of its operative length. This dictates that all of the rest of the tools in the same assembly must be reformed, whether they need it or not, in order to bring their operating ends into the proper frame of reference with respect to the new operating end of the sharpened tool. Since most of the die tools are headed, there is no choice but to work on their operating ends in order to reduce their operative length as required. Where forming tools are involved, the difficulties are compounded since the operating ends of such tools are normally quite complex and of material that is difficult to machine.

It is to the solution of the above noted problem that the present invention is directed. It provides a generally new and improved construction for work performing members in the nature of tool and die components which minimizes the time and cost entailed in servicing die assemblies as necessitated by the frequent need for sharpening or adjusting worn or damaged die components.

The present invention has special advantage in application to forming tools and dies the wear characterisitcs of which are considerably different from those of perforator type punches, for example, and their mating dies. It will accordingly be described in this frame of reference, but only by way of example and not by way of limitation.

SUMMARY OF THE INVENTION

Preferred embodiments of the invention include a work performing member having a shank end and a work performing end with the shank end being constructed and formed to enable the shank length to be simply and easily reduced. The work performing member is designed to mount a separable element which can be removably connected to form an extension of the shank end and to define a head of prescribed configuration and dimension which facilitates the mounting of the work performing member to a retainer in a required position for use. The head element and the shank end to which it relates are so configured to have an unmistakable keyed relation in their assembly. Moreover, an arrangement provided for fastening the head to the shank insures a pressured fit of one to the other which obviates the possibility of their relative rotary motion once they are interconnected.

When utilizing the features of the invention in components of a tool or die assembly, the servicing operation occasioned by a need to grind one of the working tools in the assembly can be simply and readily effected. Once the worn or damaged tool has its operating end ground, the net result is to reduce its operating length. Then one may, at his option, remove the head elements of the other tools of the same assembly which embody the present invention and grind their shank ends the amount required, whereupon the head elements may be replaced. Thus, utilizing tools constructed in accordance with the present invention will preclude any need for time consuming and difficult re-forming procedures on the tool merely to bring its operative length into conformity with that of another tool the reduction of the length of which was necessitated by reason of a need for its sharpening.

It is accordingly a primary object of the invention to provide an improved work performing device in the nature of a tool or die component which is economical to manufacture, more efficient and satisfactory in use and unlikely to create malfunction in the system in which it is embodied.

Another object of the invention is to provide a generally new tool or die component characterized by a removable and reattachable head enabling a reduction of the length of the component by removing the head, removing a portion thereof of non-critical configuration at an intermediate station thereof and replacing the head to provide once more a completely satisfactory tool or die component of shortened length which has been created in a simple and economical fashion.

Another object of the invention is to provide a tool or die component embodying a removable head portion and a work performing portion including a shank, wherein said head and said shank are formed to have an unmistakable keyed relation.

An additional object of the invention is to provide a tool or die component with a unique removable head construction facilitating a keyed application thereof to a tool or die plate.

Still another object of the invention is to obviate problems inherent in the requirement for sharpening of only certain tools or dies of a group forming an assembly thereof by providing that conforming adjustments may be made in the length of intermediate portions of the tools or dies without affecting their fit in a retainer.

An additional object of the invention is to provide multi-part working members in the nature of tool or die components possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawing wherein is shown one but obviously not necessarily the only form of embodiment of the invention.

FIG. 1 is a fragmentary view, in cross section, of a die including a forming tool and cooperating die button structured in accordance with the present invention;

FIG. 2 is a cross-sectional view taken on line 2—2 of FIG. 1, the upper die shoe being removed;

FIG. 3 is an exploded view of a forming tool such as shown in FIG. 1; and FIG. 4 is a detail view of a removable head such as utilized in tool and die button components shown in FIGS. 1–3, taken from the underside thereof.

Like parts are indicated by similar characters of reference throughout the several views.

DESCRIPTION OF THE PREFERRED EMBODIMENT OF THE INVENTION ILLUSTRATED:

FIG. 1, as above noted, shows only a portion of a die assembly as installed in a press. The press per se is not shown since the details thereof are not essential to an understanding of the present invention. Of an assembly of tools embodied in connection with the ram of the press only two are illustrated. These include a perforating type punch 10 and a forming tool 12 which have distinctively different wear characteristics. For example, in repeated use of the tool assembly the punch 10 will require sharpening several times. By contrast the forming tool 12 will normally have an operating end formed of special material which tends throughout the same period in which the punch 10 must be repeatedly sharpened to maintain its required form and characteristic of operation. As seen in FIG. 1, punch 10 and the forming tool 12 are mounted in connection with and to depend perpendicularly from a tool retainer 14. The latter is fixedly though releasably secured in an abutted relation to the lowermost surface of an upper die shoe 16 in connection with the ram of the press (not shown).

The die elements of the assembly shown are mounted in connection with a lower die plate 18. The plate 18 is secured in a flush abutted relation to the upper surface of a lower die shoe 20 which is fixed in turn to the bed of the press.

Appropriately mounted in a suspended relation to the upper die shoe 16, below and in the path of the tool retainer 14 is a stripper plate 22. Since the suspension of the stripper plate as well as the connection of the die shoes and the retainers which they mount may be contrived in any conventional manner, the details thereof are neither shown nor described.

As seen in FIG. 1, the tool retainer plate 14 includes a vertically oriented aperture 24 the longitudinal axis of which extends perpendicular to the under surface of the upper die shoe 16. The aperture 24 is counterbored at the end thereof which opens to the upper die shoe, to produce therein an annular shoulder 26 which positions in parallel relation to the under surface of the die shoe. The expansion of the upper end of the aperture 24 enables it to accommodate the expanded head end 28 of the punch 10, the peripherally projected portion of which seats to the shoulder 26 as the uppermost surface of the head 28 is caused to be backed by and established in a flush engagement with the undersurface of the upper die shoe. Immediately below its head 28 the shank of the punch 10 will be accommodated in the aperture 24 and project therefrom to have its operating end 25 dispose, in an open position of the press, in an aligned aperture 32. The latter is formed in the stripper plate 22.

Press fit in an aperture 34 in the lower die plate 18 is a tubular die button 36 which positions in a direct vertical alignment with the apertures 24 and 32. The die button 36 is one the shape and formation of which is conventional. As material of the stock S to be worked is placed between the punch 10 and the lower die plate and the press is closed, the punch 10 will pass through the work material S to displace a slug-like portion thereof in accordance with the nature and configuration of its operating end. As may be seen, the punch drives the separated slugs through the central passage 38 defined by the die button 36 so that it may drop through the expanded lower end thereof to a suitable receptacle provided at the lower end of the press.

In accordance with the present invention the forming tool 12 is inclusive of a work performing element 40. The element 40 includes a working or operating end 42 the projected extremity of which has a special configuration in accordance with its required function. In the case illustrated, the operating end 42 is designed to displace longitudinally spaced portions of the material S disposed in its path to form therein a U-shape section. The portion of the element 40 remote from its operating end 42 may be designated its shank end 46 the upper or outermost extremity of which is formed to provide a flat 48 which lies in a plane perpendicular to the longitudinal axis of the element 40. Formed in the peripheral surface of the element 40 at its end 46, which, as may be seen, has a circular outline, is a notch. This notch produces on one side of the shank end 46, at its outermost extremity, a flat 50 which orients in a sense perpendicular to the flat 48 and extends in a sense axially of the body of the tool 12. The flat 50 lies in a plane which intersects a chord of the circle defined by the peripheral outline of the body of the shank portion 46 of the element 40. At a terminal portion of the flat 50 in a sense inwardly from the flat 48, the notch forms a shoulder 52 which lies in a plane parallel to that occupied by the flat 48. Opening from the flat 48 and directed inwardly of the body of the element 40 at its center is a relativey deep, axially directed, tapped recess 54.

It will be seen that the shank end of the element 40 is headless and positions in an aperture 56 in the tool retainer 14 which is circular in cross section and conventionally expanded at the upper end thereof which opens to the upper die shoe 16 by a counterbore 58. The second element of the forming tool 12 is a head element 60. Referring to the drawings, the head 60 is a plate member which has a disc-like shape one surface of which is adapted to be flush abutted to the surface 48 as the head is slip fit to form an extension of the shank end of the work performing element 40. In its connected relation to the element 40, to be described, the head 60 substantially fills the counterbore 58 as the outer or upper surface thereof is positioned thereby in an abutted relation to the undersurface of the upper die shoe 16.

The peripheral configuration and dimension of the disc-like plate member 60 provides that in connection thereof to form a head on the shak end of the element 40 the peripheral edge portion thereof will produce thereon a radial peripherally projected flange portion 64 which has the generally circular character of its peripheral outline intercepted by a flat 66. The latter defined a chord of the otherwise circular configuration of the head. As may be seen in FIG. 2, the flat 66 lies in a plane which is tangential to the circular configuration of the outer periphery of the shank end portion 46 of the element 40. Formed integral with the under surface of the disc-like plate member 60 remote from that which abuts the upper die shoe 16 is a projection 68 having a cross sectional configuration to fill the notch in the adjacent end portion of the shank, created when material was removed in the formation of the flat 50. The projection 68 is thus designed to serve as a key embodying a flat surface 70 which is intended to and does flush abut the flat 50 in the assembly of the head element 60 to the element 40. It will be noted from FIG. 2 of the drawings that upon application of the key portion 68 to the shank end of the element 40 its outer peripheral configuration other than the flat 70 is uniformly arcuate so it will, in effect, complete the circular configuration of the other periphery of the shank end of the element 40 and thereby act therewith to conform to and fill the upper cross sectional area of the aperture 56 in the tool retainer 14 adjacent the counterbore portion 58.

Referring to FIG. 3 of the drawings, it will be seen that with the head 60 appropriately slip fit or in like manner applied to form an extension of the shank end of the element 40, it will be non-rotatively positioned. To achieve a fixed releasable connection of the element 60 to the element 40 the head 60 is provided with an aperture 72 counterbored at its upper or outermost end to provide therein a conically expanded portion 74. In this instance counterbore 74 is so configured to accommodate the complementarily shaped head 76 of a screw 78 which is applied to and through the aperture 72 to threadedly engaged in the wall structure provided by the axially aligned tapped recess 54 in the body of the shank end of the element 40. Attention is particularly directed to the fact that the radial dimension effected between the center of the aperture 72 in the head 60 and the flat 70 provided on the key 68 is designed to be slightly less than the radial dimension between the center of the tapped recess 54 and the flat 50. This dictates that as the flat 70 on the key element 68 is applied to the flat 50 and the screw 78 used to connect the head 60 to the shank 46 of the work performing member, the flats will be drawn into a firmly abutted relation which precludes relative displacement or ready loosening of the parts.

Note that the depth of the recess 54 is such to exceed the length of the body of the screw 78. This enables that each time the shank end 46 is shortened (within prescribed limits), the head 60 may be reapplied and similarly locked in position, whereby to maintain the required configuration of the composite work performing member constituted by the elements 40 and 60 as connected by the screw 78.

Thus, the connection of the elements 40 and 60 produces a tool comprised of a work performing end the integral shank extension of which is continued by the disc-like plate 60 which forms on the shank a head having a peripherally protruding flange segment which seats in the counterbored portion 58 of the aperture 56 which otherwise accommodates the shank end of the element 40. As thus comprised the tool 12, in its assembled condition, will be securely and firmly supported in the tool retainer 14 with the uppermost surface of its component structure in flush abutted relation to and backed by the die shoe 16.

The flat 66 provided on the flange 64 facilitates a locking of the tool 12 against rotative movement in its retainer by means of alignment pins 80 formed and applied to the flat 66 and in the tool retainer plate 14 in a manner such as described in U.S. Letters Pat. No. 3,797,352. Details in respect to the use, positioning and application of the alignment pins 80 may be readily understood with reference to said patent. Note, however, that flat 66 and flat 70 on the key portion 68 which in the application thereof abuts the flat 50 are parallel. Thus, the application of the pins 80 to the head 60 will produce a further and direct application of parallel lines of holding pressure between these flats which are symmetrically arranged with respect to the flat 50 on the shank end of the element 40.

Thus, the construction of the tool 12 not only insures its highly advantageous usage in the manner described but a most accurate and firmly established location thereof in a retainer.

As seen in FIG. 1 of the drawings, the stripper plate 22 has, in direct alignment with the operating end of the element 40, an aperture 84 the wall of which affords free passage and guide for the operating end of the forming tool as the press is closed to fabricate an article of manufacture from the stock S positioned between the stripper plate 22 and the lower die plate 18.

Of course, there may be any number and nature of tools embodied in connection with the retainer 14. At least those tools which have lesser tendency to require sharpening or modification will all be constructed as described with reference to the tool 12 to comprise a work performing portion to the shank end of which is connected an element such as the head 60.

As may be clearly and easily seen, therefore, each time the punch 10 is sharpened and thereby reduced in length to change the frame of reference of its operating end, all the other type tools including the tool 12 may simply have their heads removed and their shank ends simultaneously ground to be correspondingly reduced in length in a simple and inexpensive fashion, following which their heads may be reattached, whereupon all the tools or work performing members may be replaced in their retainer plate 14. When this is done the operating ends of all the tools of the assembly, as exemplified by the tools or work performing members 10 and 12 here illustrated, will be in the proper relation as they are moved to perform their required functions on the stock S.

FIG. 1 of the drawings also illustrates the application of the invention in fabricating the forming die component 94 which cooperates in use with the tool 12. Since the details thereof are obvious, it does not appear that they need be minutely described. In general, however, the die component which cooperates with the forming end 42 of tool 12 is comprised of an element 90 having a male configured operating end 92. The latter is formed to complementarily nest in the female configuration 44 of the operating end 42 of the member 12 as the die is closed upon the stock S. The element 90 includes a shank portion 94 forming an axial extension of its operating end and having a configuration similar to that of the shank end of the member 40, at its outermost extremity. The latter is capped by a head element 60′ formed and connected to the shank end 94 in a fashion identical with that in which the head 60 is connected to the shank end 46 of the element 40.

Thus, in case, for example, as will frequently occur, the die button 36 should rapidly wear in use thereof, requiring its grinding and a grinding of the upper surface of the die plate 18, rather than it being necessary to grind correspondingly the complicated operating end 92 of the forming die, the forming die may be reduced at an intermediate station. This may be easily achieved by removing the head 60′ and grinding the shank end of the element 90 to remove sufficient material that upon replacement of the head 60′ and reassembly of the composite die structure its operating end will position in the proper frame of reference to the position of the operating end of the die button 36 and the reduction in thickness of the plate 18. As in the case of the tools of the upper assembly, the die members of the lower assembly may comprise, in the case of those which do not require frequent reforming as does the die button 36, an element having an operating end and a shank end, the latter of which is particularly formed as the shank end of the element 40 and capped by a head such as 60′ which conforms in configuration and application to that of the head 60 previously described.

Attention is directed to the fact that where the preferred application of the alignment pins 80 is not employed that the flange provided by the head 60 or 60' may be formed without a flat and advantages as afforded by the invention will still obtain.

It is believed that from the foregoing one may readily observe how simply and effectively the present invention enables the aforementioned problems of the prior art to disappear. One can have inexpensive tools and dies and have, moreover, such tocls and dies in a composite form to facilitate the simplest of procedures for reduction of their length at an intermediate station thereof in a manner to obviate complex, time consuming and expensive reforming operations on their outer ends at time when the same is not essential. When one adds to this the savings in down time normally anticipated in use of conventional means and methods for doing the same thing, the benefits of the invention are seen to be significant, simple though the solution may be.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A work performing member, including a shank end and a work performing end, said shank end being constructed for easy reducibility of the shank length and having an axially directed tapped recess opening from a surface of said shank end defining its outer extremity, a peripheral portion of said shank end having a flat thereon, a head element applicable to said surface and having an aperture therein, said head element having a key portion thereon configured substantially to replace the material removed from said shank end in providing said flat, said key portion interfitting with said flat to prevent the relative displacement of said head element in a rotative sense upon application to said shank end, and means inserted through the aperture in said head element into said tapped recess to form a connection between said head element and the shank end to which it is applied, there being a differential in the relationship of the aperture in said head element to said key portion thereon as compared to the relationship of the tapped recess in said shank end to said flat thereon providing that in the connection of said head element to said shank end said key portion will have a pressured engagement with said flat.

2. A work performing member, including a shank end and a work performing end, said shank end being constructed for easy reducibility of the shank length, a separable head element on said shank end of prescribed configuration and dimension for mounting the work performing member in a required position for use, said head element being removably applied to said shank end as an extension thereof and having a central aperture and a projected key portion formed to include a flat, the outermost end of said shank end having a tapped recess and on its periphery a flat abutted by said flat on said key portion, and the distance from the center line of said aperture to said flat on said key portion being somewhat less than the distance from the center line of said tapped recess to the flat on the periphery of said shank end.

3. A work performing member, including a shank end and a work performing end, said shank end being constructed for easy reducibility of the shank length, a retention head element separably applied to said shank end to form an extension thereof in a longitudinal sense and projecting peripherally thereof in a transverse sense, a portion of the periphery of said shank end and a projected key portion of said head element being formed and arranged to interfit upon application of said head element to said shank end to inhibit a rotation of one relative to another.

4. A work performing member according to claim 3 characterized by means releasably securing said head element to said shank end, said securing means incorporating means utilizing a tightening thereof to urge said key portion against said peripheral portion of said shank end.

5. A work performing member according to claim 3 wherein the peripheral portion of said shank end which interfits with said key portion is provided by a flat thereon, said key portion having a configuration substantially to replace the material removed from said shank end in providing said flat and occurring as a portion dependent from said head element and offset from the center thereof.

6. A work performing member according to claim 5, wherein said shank end has a transverse end surface to which said head element is applied, said shank end having a tapped recess opening through said end surface, said head element having an aperture therein, and means inserted in the aperture in said head element and said recess to releasably connect said shank end and said head element.

7. A work performing member, including a shank having an end configured for work performance and an opposite end configured for easy reducibility of the shank length, and a retention head removably mounted to said opposite end for easy access thereto, said retention head having on an underside thereof a radially offset dependent key portion, said key portion having a flatted wall facing inwardly toward the axis of said head, said shank having a peripheral flat thereon intersecting the said opposite end of said shank, application of said head to said opposite end of said shank in a selected rotational position placing said flatted wall on said key portion in adjacent parallel relation to the peripheral flat on said shank, and means for securing said head to said shank to urge said flatted wall and said peripheral flat into intimate contacting relation.

8. A work performing member according to claim 7, wherein said shank has a tapped recess opening through said opposite end thereof axially of said shank and said head has an aperture therethrough, said securing means including screw means installed through said aperture and received in said tapped recess, said tapped recess having a depth to receive said screw means throughout aa programmed reduction in the length of said shank.

9. A work performing member according to claim 8, wherein said head aperture has a tapering counterbore and said screw means has a surface of complementary configuration received in said counterbore, the distance from the center line of said head aperture to said flatted wall being somewhat less than the distance from the center line of said tapped recess to said peripheral flat.

10. A work performing member according to claim 7, wherein said head has a peripheral locking pin bearing surface located to the outer side of said key portion comprising a flat parallel to the flatted wall of said key portion.

* * * * *

UNITED STATES PATENT AND TRADEMARK OFFICE

CERTIFICATE OF CORRECTION

PATENT NO. : 3,983,739

DATED : October 5, 1976

INVENTOR(S) : Allan E. Randolph, Sr.

It is certified that error appears in the above-identified patent and that said Letters Patent are hereby corrected as shown below:

Col. 1, line 33, "terisitcs" is corrected to read -- teristics --.

Col. 4, line 22, "relativey" is corrected to read -- relatively --.

Col. 4, line 42, "shak" is corrected to read -- shank --.

Col. 4, line 47, "defined" is corrected to read -- defines --.

Col. 4, line 65, "other" is corrected to read -- outer --.

Col. 5, line 14, "engaged" is corrected to read -- engage --.

Col. 7, line 17, "time" is corrected to read -- times --.

Col. 9, line 2, "aa" is corrected to read -- a --.

Signed and Sealed this

Twenty-first Day of December 1976

[SEAL]

*Attest:*

RUTH C. MASON
*Attesting Officer*

C. MARSHALL DANN
*Commissioner of Patents and Trademarks*